United States Patent [19]

Sieradzki

[11] Patent Number: 4,679,358

[45] Date of Patent: Jul. 14, 1987

[54] GRINDING WHEEL ADVANCING APPARATUS

[75] Inventor: Christopher Z. Sieradzki, Homewood, Ill.

[73] Assignee: AMSTED Industries Incorporated, Chicago, Ill.

[21] Appl. No.: 842,111

[22] Filed: Mar. 20, 1986

[51] Int. Cl.[4] ..... B24B 49/00

[52] U.S. Cl. ..... 51/165.72; 51/165.87

[58] Field of Search ..... 51/165.72, 165.87, 165.88

[56] References Cited

U.S. PATENT DOCUMENTS

| | | | |
|---|---|---|---|
| 1,228,798 | 6/1917 | Maag | 51/165.88 |
| 2,600,481 | 6/1952 | Clyde | 51/165.77 |
| 3,791,084 | 2/1974 | Kakuma | 51/165.87 |
| 4,020,601 | 5/1977 | Gray | 51/165.72 |
| 4,370,834 | 2/1983 | Habib | 51/165.72 |

FOREIGN PATENT DOCUMENTS

| | | | |
|---|---|---|---|
| 247787 | 3/1947 | Sweden | 51/165.72 |

*Primary Examiner*—Harold D. Whitehead

*Attorney, Agent, or Firm*—Charles E. Bouton; Edward J. Brosius

[57] ABSTRACT

A grinding apparatus is provided with an automatic adjustment device. After each grinding operation, the grinding wheel position is adjusted to a light beam position by the activation of a carriage movement device. This assures that the grinding wheel will grind each object to the same depth irregardless of wheel wear, which is compensated for in the position adjustment operation.

1 Claim, 2 Drawing Figures

GRINDING WHEEL ADVANCING APPARATUS

BACKGROUND OF THE INVENTION

The present invention relates to grinding wheel apparatus and, more particularly, to a grinding wheel advancing apparatus capable of adjusting the position of the grinding wheel in relation to wear of the wheel.

In certain operations such as hardness testing of metal objects such as railway wheels, it is necessary prior to such hardness testing to grind a small area of the object. In order not to damage the object for its intended use, it is desirable to grind only to a preselected depth, thereby removing only a small amount of metal from the object being tested. In high output production operation, it is desirable to have such grinding operation automated. One problem which has arisen in the automating of such operation is the wear of the grinding wheel. With the grinding wheel diameter constantly decreasing due to wear, it has proven difficult to automate a process wherein a constant relatively shallow depth of metal is removed from the object.

Accordingly, it is an object of the present invention to provide a grinding apparatus capable of adjusting the grinding wheel position dependent on wheel wear.

SUMMARY OF THE INVENTION

The present invention provides a grinding apparatus wherein the position of the grinding wheel can be automatically adjusted dependent on grinding wheel wear.

The grinding wheel and its drive motor are mounted on a carriage assembly. This carriage assembly itself is mounted on a base carriage assembly. When the base carriage is moved laterally against a stop, the grinding wheel is designed to be in contact with the object to be ground. The grinding wheel is subject to wear, and after a certain amount of grinding, the wheel will wear and the same depth of grinding in each object will not be attained. It becomes necessary to adjust the position of the grinding wheel to compensate for such wear.

A sensing device is provided whereby the desired extension of the grinding wheel can be detected. This sensing device takes the form of a light emission source and light sensing receiver. The type of light emission source and light sensing device will no doubt depend on the state of the art in such devices. A source giving a relatively fine beam with an accurate receiver is required for the present invention, but manufacturing tolerances with requisite sturdiness are necessary for the equipment rather than laboratory tolerances. A light beam is projected from the source and extends across the area where the grinding wheel will contact the object to be ground. If the wheel is extending the desired distance such that the desired amount of the object will be ground away, the light beam will be broken by the wheel and no adjustment to the positioning of the grinding wheel will be made. However, if the grinding wheel is worn, the light beam will enter the sensing receiver. Appropriate electrical circuitry will activate appropriate devices such as a screw drive assembly to move the carriage assembly and thereby the grinding wheel until the light beam is broken by the grinding wheel and movement of the carriage assembly is stopped.

The present invention is particularly suitable for manufacturing operations wherein a relatively large number of objects must be tested. The automated adjustment of the grinding wheel depth assures uniform grinding which will not affect the performance characteristics of the objects. Further, the apparatus provides a rapid readjustment of the grinding wheel position which can be accomplished as necessary and, if necessary, after every grinding operation. Such an automated step assures greater accuracy in the grinding operation.

DESCRIPTION OF THE PREFERRED EMBODIMENT

Figure 1:
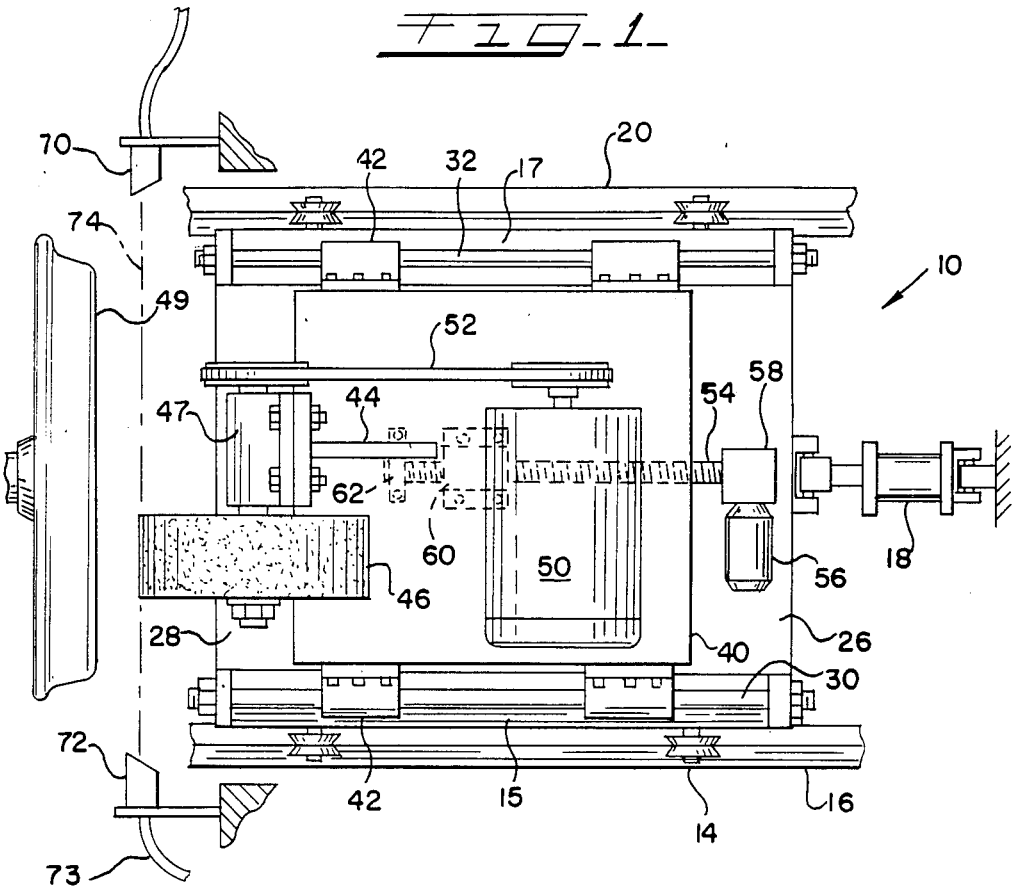
FIG. 1 is a top view in partial cross section of the grinding wheel adjustment device of the present invention in a fully retracted position.
Figure 2:
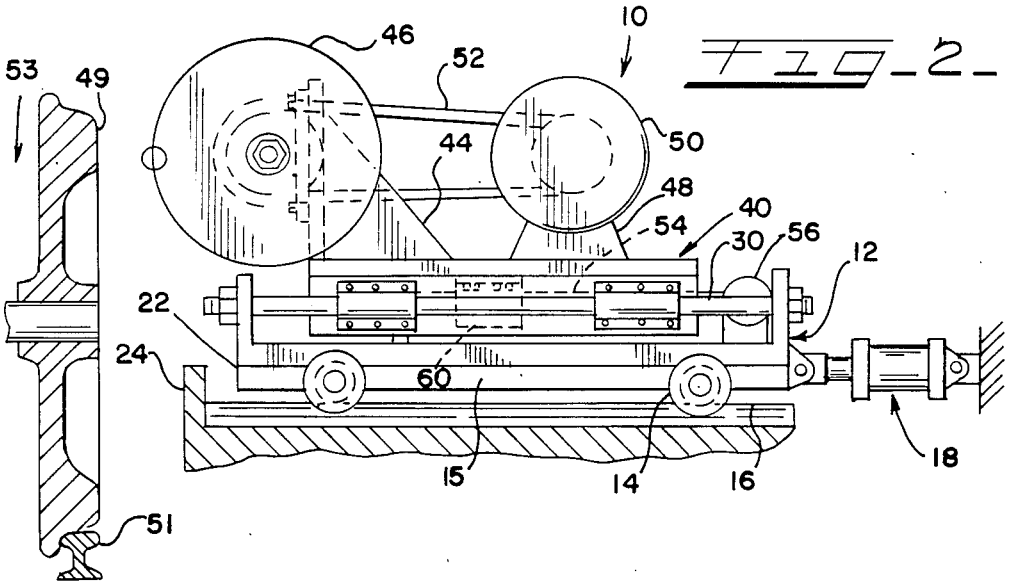
FIG. 2 is a side view in partial cross section of the grinding wheel adjustment device of the present invention in a fully retracted position.

Referring now to FIGS. 1 and 2 of the drawing, an embodiment of the grinding wheel adjustment apparatus of the present invention is shown generally at 10. A generally square shaped base carriage assembly 12 is comprised of side rails 15 and 17 joined at both ends by cross rails 26 and 28. Wheels 14 are affixed to side rails 15 and 17 thereby enabling base carriage 12 to move laterally along tracks 16 and 20. A drive mechanism such as hydraulic cylinder 18 is attached to cross rail 26 thereby enabling the lateral movement of base carriage 12 to be powered and controlled. Further, each track 16 and 20 is provided with a stop such as stop 24 on track 16. Forward end 22 of side rail 15 would contact stop 24 to thereby limit the lateral movement of base carriage 12 to the left in FIGS. 1 and 2. Further, mounting rails 30 and 32 are affixed to upward extensions of side rails 15 and 17, respectively.

Grinder carriage 40 is a generally box-shaped structure having linear bearings 42 extending from both sides thereof. Linear bearings 42 receive mounting rail 30 on one side of grinder carriage 40 and mounting rail 32 on the other side of grinder carriage 40 to mount grinder carriage 40 so that it is laterally movable along base carriage 12.

Grinder wheel 46 is supported on grinder carriage 40 by wheel support 44. Drive motor 50 is supported on grinder carriage 40 by motor support 48. Drive belt 52 operatively connects the output shaft of motor 50 to wheel gear assembly 47 to thereby drive wheel 46. Wheel 46 is brought into contact with railway wheel 49 when base carriage 12 is moved against stop 24. Railway wheel 49 is moved into position to be ground along track 51 and is held in position to be ground by clamping mechanism 53.

A screw drive assembly including shaft 54 is provided to move grinder carriage 40 laterally along mounting rails 30 and 32 of base carriage 12. Motor 56 is connected to gear mechanism 58 which in turn accepts one end of shaft 54. Motor 56 and gear mechanism 58 are mounted on a rear portion of base carriage 12. Shaft 54 passes under grinder motor 50 and through a bearing mechanism 60 which is attached to the underside of grinder carriage 40. The other end of shaft 54 is held in support 62 attached to the upper surface of base carriage 12. Upon the activation of motor 56, shaft 54 is rotated and guide carriage 40 is moved with respect to base carriage 12 along mounting rails 30, 32.

Light transmitting device 70, when activated, emits a beam of light 74. When base carriage 12 is fully retracted (to the right in FIGS. 1 and 2), and if grinding wheel 46 is of a diameter indicating acceptable wear conditions, grinding wheel 46 will block light beam from entering light receiving device 72. However, if from the most recent grinding operation grinding wheel 46 is worn to a diameter of less than acceptable wear conditions, light beam 74 will reach light receiving device 72. A signal will be sent via cable 73 to an activating device (not shown) which will turn on motor 56. Shaft 54 will be turned, thereby advancing grinder carriage 40 and grinding wheel 46. Grinding wheel 46 will be advanced until it breaks light beam 74, upon which the activating signal to motor 56 will be terminated. Shaft 54 will cease rotation, and grinder carriage 40 will stop. Grinding wheel 46 is thereby repositioned automatically adjusting for wear.

Light emitting device 70 can take several forms including a fiber optic light or even a low power laser. Great accuracy in the adjustment of the position of grinder carriage 40 and grinding wheel 46 is thereby obtained.

Because base carriage 12 is withdrawn to the same retracted position after each grinding operation, the adjustment of the position of grinding wheel 46 to the light beam position will assure the uniform grinding of objects. As the grinding operation is initiated and base carriage 12 is rolled against track stop 24, grinding wheel 46 will protrude to the left (FIGS. 1 and 2) of stop 24 the exact same amount for each grinding operation.

What is claimed is:

1. A grinding apparatus comprising a first carriage means mounted on a track assembly, a first drive means adapted to move said first carriage means laterally along said track assembly to an operating position and a fully retracted position, a second carriage means mounted on said first carriage means, a second drive means mounted on said first carriage means and adapted to move said second carriage means laterally along said first carriage means, a grinding wheel assembly mounted on said second carriage means, said grinding wheel assembly including a grinding wheel and a drive mechanism, a sensing mechanism comprising a light source emitting a light beam and a light receiver so positioned such that when said first carriage means is at said fully retracted position, and said grinding wheel is within acceptable wear condition, said light beam when activated will be blocked from entering said light receiver by said grinding wheel, and when said first carriage means is at said fully retracted position and said grinding wheel is worn beyond preselected wear conditions, said light beam when activated will be able to enter said light receiver and thereby activate said second drive means to laterally move said second carriage means until said grinding wheel blocks said light beam thereby deactivating said second drive means, and wherein said second drive means comprises a screw mechanism connected at one end to a motor mounted on said first carriage, an engaging gear mounted on said second carriage means with said screw mechanism passing through said engaging gear, such that upon rotation of said screw mechanism, said second carriage means is moved in relation to said first carriage means.

* * * * *